United States Patent [19]

Hart et al.

[11] 4,305,545

[45] Dec. 15, 1981

[54] CARTON WITH ARTICLE RETAINING STRUCTURE

[75] Inventors: Joseph J. Hart; John D. Desmond, both of Philadelphia, Pa.

[73] Assignee: Container Corporation of America, Chicago, Ill.

[21] Appl. No.: 170,723

[22] Filed: Jul. 21, 1980

[51] Int. Cl.[3] ..... B65D 5/08

[52] U.S. Cl. ..... 229/37 R; 206/480

[58] Field of Search ..... 215/37 R, 38; 206/472, 206/476, 480, 482

[56] References Cited

U.S. PATENT DOCUMENTS

| | | | |
|---|---|---|---|
| 2,163,045 | 6/1939 | Lavere | 229/37 R |
| 2,167,918 | 8/1939 | Vogt | 229/37 R |
| 2,739,752 | 3/1956 | Pritchett | 229/37 R |
| 3,777,969 | 12/1973 | Nurre | 229/37 R |
| 4,128,168 | 12/1978 | Roccaforte | 206/476 |
| 4,169,539 | 10/1979 | Price | 229/38 |
| 4,230,259 | 10/1980 | Herzog | 229/38 |

*Primary Examiner*—Herbert F. Ross

*Attorney, Agent, or Firm*—R. W. Carpenter; Davis Chin

[57] ABSTRACT

A paperboard carton having integral internal structure for retaining a packaged article in a fixed position.

4 Claims, 6 Drawing Figures

CARTON WITH ARTICLE RETAINING STRUCTURE

SUMMARY OF THE INVENTION

The invention relates to folding cartons of the type used for the packaging of articles such as filled trays having flanges projecting laterally outward from upper portions thereof.

In packaging bakery type items which are contained in trays, it is essential to the protection of the packaged article that the tray be maintained in a fixed position against one wall, such as the bottom wall, of the carton.

It is therefore an object of the present invention to provide a folding carton formed from a unitary blank of foldable sheet material, such as paperboard, which includes an integral structure for engaging a portion of the packaged article and holding it against the bottom wall of the carton.

These and other objects of the invention will become apparent from an examination of the following description and drawings.

THE DRAWINGS

Figure 3:
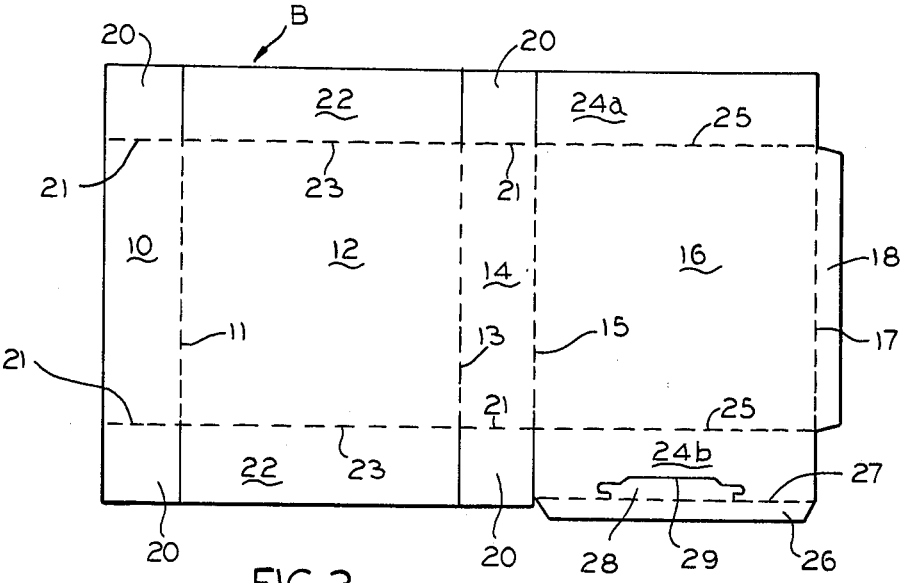
Figure 1:
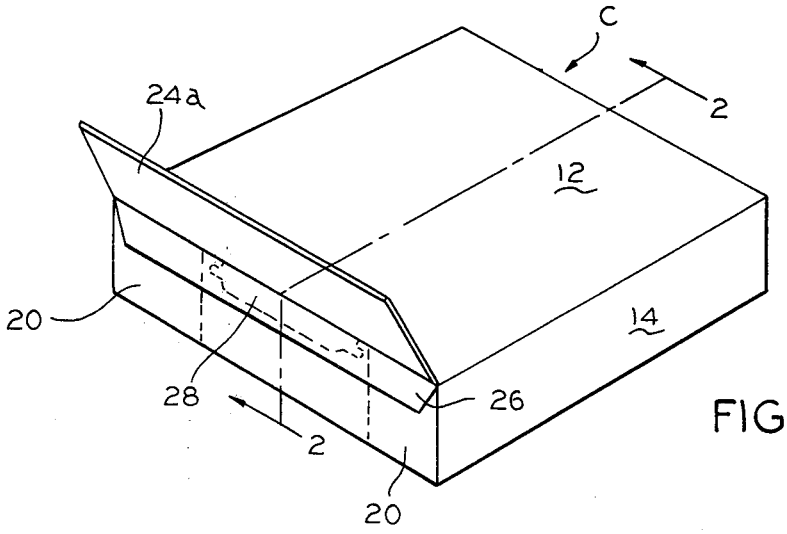
FIG. 1 is a perspective view of a carton embodying one form of the invention, as seen with a packaged article in position therewithin.
Figure 2:
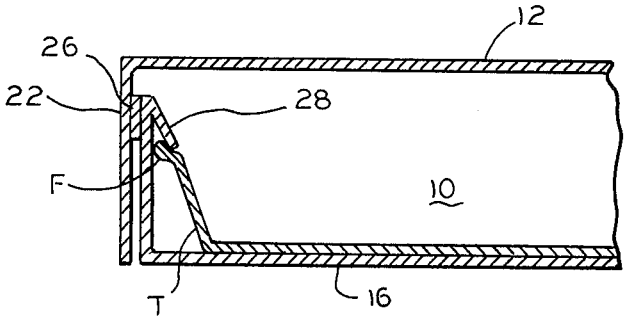
FIG. 2 is a vertical section taken on line 2—2 of FIG. 1.
Figure 6:
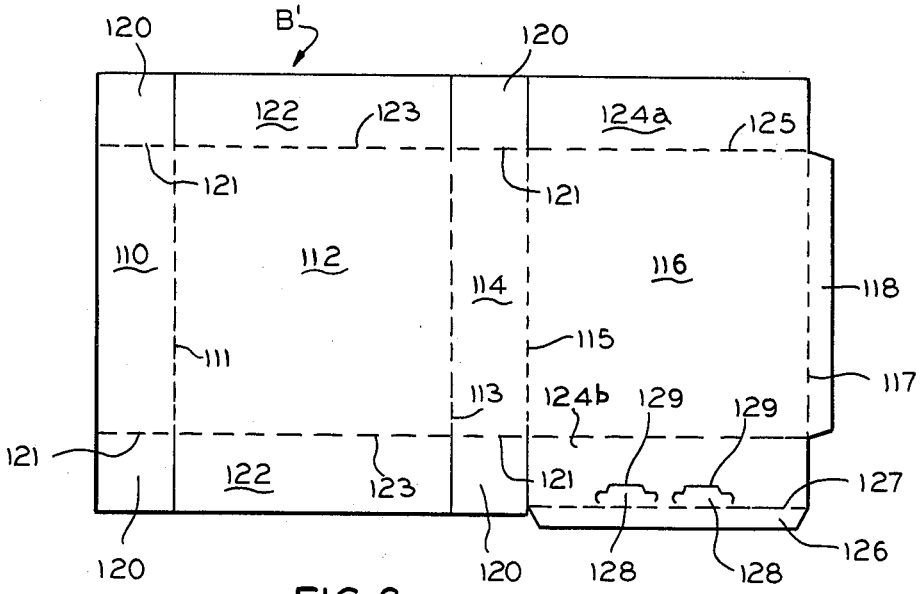
Figure 4:
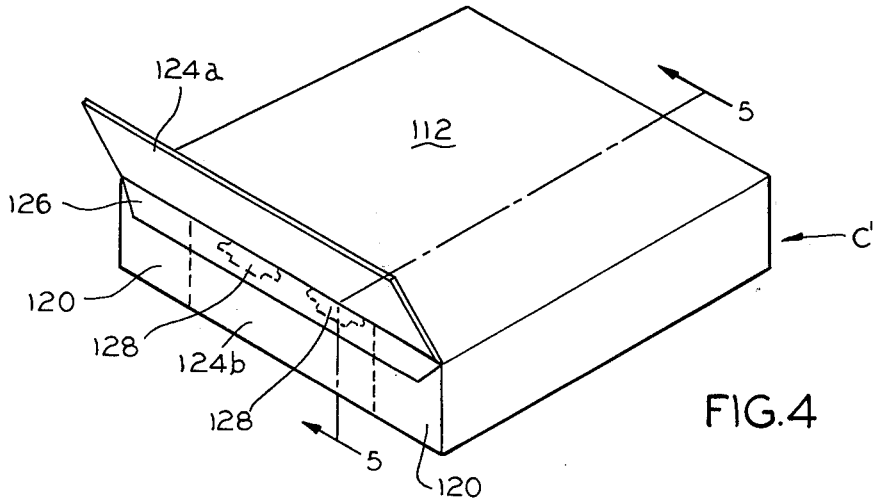
Figure 5:
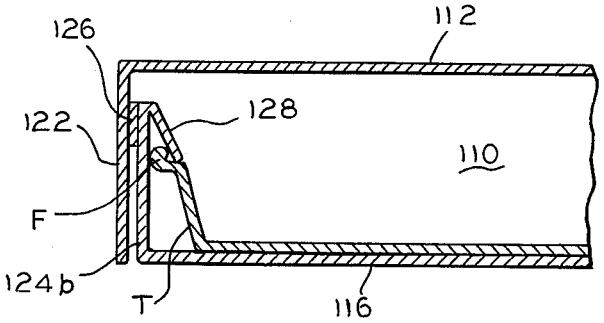

FIG. 3 is a plan view of a blank of foldable sheet material from which the carton illustrated in FIGS. 1 and 2 may be formed; and FIGS. 4, 5 and 6 are views similar to 1, 2 and 3, respectively, but illustrating a modified form of the invention.

It will be understood that, for purposes of clarity, certain elements may have been intentionally omitted from certain views where they are believed to be illustrated to better advantage in other views.

THE DESCRIPTION

Referring now to the drawings for a better understanding of the invention, it will be seen that the Carton C illustrated in FIGS. 1 and 2, may be formed from a unitary blank B of foldable sheet material such as paperboard illustrated in FIG. 3.

The carton is adapted to enclose a Tray T having at its upper end a peripheral flange F.

As best seen in FIG. 3, the body of the carton includes a first side wall 10, a top wall 12, a second side wall 14, a bottom wall 16, and a glue flap 18, which are foldably joined to each other along parallel fold lines 11, 13, 15 and 17, respectively.

Opposed pairs of minor end wall panels or dust flaps 20 are foldably joined on fold lines 21 to opposite ends of first and second side walls 10 and 14, respectively.

A pair of opposed major outer end wall panels 22 are foldably joined on fold lines 23 to opposite ends of top wall 12. A pair of opposed major inner end wall panels **24*a* and 24*b* are foldably joined on fold lines 25 to opposite ends of bottom wall 16**.

At least one of the major outer closure panels, **24*b*, is provided with an extension 26 which is foldably joined to its outer edge along fold line 27. Panel 24*b* is also provided with a lock flap 28 which is formed from material cut from panel 24*b* and is defined by a cut line 29 which extends from one portion of fold line 27 to another portion of fold line 27. Thus, lock flap 28 is also foldably joined to panel 24*b* by fold line 27**.

As best seen in FIGS. 1 and 2, when the tray F is inserted within the carton, minor end wall flaps 20 are folded inwardly at right angles to their related side walls and major inner end wall panel **24*b* is then folded upwardly at right angles to the bottom wall. When the major outer end wall panel 24*a* is then folded downwardly at a right angle to the top wall, extension 26 of panel 24 is automatically folded downward so as to be sandwiched between panels 24*a* and 24*b*. This causes the lock tab 28 to automatically be folded out of the plane of panel 24*b* so that it projects downwardly and inwardly into the carton into contact with the upper portion of tray T to maintain it in a fixed position against the bottom wall 16** of the carton.

Referring now to FIGS. 4–6 of the drawings, it will be seen that a slightly modified form of the invention is shown.

In this embodiment the structure is very similar to that of the previously described embodiment and related numerals have been used to describe elements of the structure which correspond to those described in connection with the first embodiment.

The only difference in the structure of this embodiment is instead of providing a single lock tab 28, there are provided a pair of spaced lock tabs 128, which are defined by spaced cut lines 129, but which operate in the same manner as the single lock tab of the previous embodiment to engage an upper portion of the tray T and maintain it in fixed position within the carton.

We claim:

1. A carton, formed of a unitary blank of foldable paperboard, including integral structure for holding in a fixed position against one wall of the carton, a tray having a flange projecting laterally outward from an upper portion thereof, said carton comprising:

(a) a pair of opposed top and bottom horizontal walls;

(b) opposed pairs of side and end vertical walls foldably joined to each other on first fold lines and to said horizontal walls on second fold lines which extend normal to said first fold lines, to define a box-like enclosure;

(c) one of said end walls including a pair of outer and inner end wall panels foldably joined to corresponding ends of said horizontal walls;

(d) said inner end wall panel including:

(i) a first flap foldably joined thereto and interposed between said inner and outer end wall panels;

(ii) a second flap foldably joined thereto and disposed to extend downwardly into said carton for engagement with said tray to hold said tray in a fixed position in said carton against said bottom wall.

2. A carton according to claim 1, wherein said first flap is foldably joined on a fold line to the upper edge of said inner end wall panel.

3. A carton according to claim 2, wherein said second flap is cut from material of said inner end wall panel and is folded thereto on a fold line which is aligned with the fold line which joins said inner end panel to said first flap.

4. A carton according to claim 1, and including at least one additional second flap foldably joined to said inner end wall panel.

* * * * *